US005644968A

United States Patent [19]

Kimura et al.

[11] Patent Number: 5,644,968

[45] Date of Patent: Jul. 8, 1997

[54] VARIABLE CAPACITY SWASH PLATE TYPE COMPRESSOR WITH AN IMPROVED HINGE UNIT FOR INCLINABLY SUPPORTING A SWASH PLATE

[75] Inventors: Kazuya Kimura; Osamu Hiramatsu; Shigeki Kanzaki, all of Kariya, Japan

[73] Assignee: Kabushiki Kaisha Toyoda Jidoshokki Seisakusho, Kariya, Japan

[21] Appl. No.: 665,541

[22] Filed: Jun. 18, 1996

[30] Foreign Application Priority Data

Jun. 20, 1995 [JP] Japan ..... 7-153179
Nov. 2, 1995 [JP] Japan ..... 7-286156

[51] Int. Cl.[6] ..... F01B 3/00; F01B 13/04

[52] U.S. Cl. ..... 92/12.2; 92/57; 92/71; 417/222.1; 74/60

[58] Field of Search ..... 92/12.2, 57, 71; 417/222.1, 222.2, 269; 91/505; 74/60

[56] References Cited

U.S. PATENT DOCUMENTS

| | | | |
|---|---|---|---|
| 4,175,915 | 11/1979 | Black et al. . | |
| 4,979,877 | 12/1990 | Shimizu | 92/71 |
| 5,094,590 | 3/1992 | Carella et al. | 92/12.2 X |
| 5,125,803 | 6/1992 | Terauchi | 92/12.2 X |
| 5,316,446 | 5/1994 | Kimura et al. . | |
| 5,387,091 | 2/1995 | Kawaguchi et al. . | |
| 5,425,303 | 6/1995 | Shimizu et al. | 92/12.2 |
| 5,509,346 | 4/1996 | Kumpf | 92/12.2 |
| 5,540,559 | 7/1996 | Kimura et al. . | |

FOREIGN PATENT DOCUMENTS

| | | |
|---|---|---|
| 2424423 | 11/1979 | France . |
| 4328114 | 2/1994 | Germany . |
| 4411926 | 10/1994 | Germany . |
| 4290951 | 12/1994 | Germany . |
| 52-96407 | 6/1977 | Japan . |
| 1114988 | 8/1989 | Japan . |
| 6288347 | 11/1994 | Japan . |

*Primary Examiner*—Hoang Nguyen
*Attorney, Agent, or Firm*—Burgess, Ryan & Wayne

[57] ABSTRACT

The hinge unit K of a variable capacity swash plate type compressor has support arms protruded to the back side of a rotor on the rotating drive shaft, and guide pins, one end of which is fixed to a rotatable and wobbling swash plate. The support arms have guide holes (guide surfaces) which extend in a predetermined direction having an angle α with respect to an axis perpendicular to the axis of rotation of the drive shaft. Sections perpendicular to the center lines $L_1$ of the guide holes are formed into at least a partial circle. A spherical elements of the guide pins are slidably and rotatably engaged with the guide holes of the support arms to be in line contact with the guide surface of the guide holes. The angle α is set so that the top clearance TC of the respective pistons at both maximum and minimum compression capacities of the compressor is equivalent.

6 Claims, 5 Drawing Sheets

VARIABLE CAPACITY SWASH PLATE TYPE COMPRESSOR WITH AN IMPROVED HINGE UNIT FOR INCLINABLY SUPPORTING A SWASH PLATE

BACKGROUND OF THE INVENTION

1. Field of the Invention

The present invention relates generally to a variable capacity swash plate type compressor, and more particularly relates to a hinge means for pivotally and inclinably supporting a swash plate of a variable capacity swash plate type compressor suitable for use in an air conditioning system of an automobile.

2. Description of the Related Art

Conventional variable capacity swash plate type compressors are disclosed in U.S. Pat. No. 4,073,603 granted to Abendschein et al. and in Japanese Unexamined Utility Model Publication (Kokai) No. 1-114988. For example, the latter compressor is provided with a hinge unit shown in FIG. 4, in which a rotor 91 is fixed to a drive shaft 90 disposed in a crank chamber, and a long hole 91*a* is formed in the rotor 91. As best shown in FIG. 5, the long hole 91*a* of the rotor 91 is parallel with a plane determined by the central axis "y" of the drive shaft 90, and the top dead center of a rotary swash plate 93, and the long hole 91*a* extends toward the central axis "y" of the drive shaft 90 from the radially outside of the drive shaft so that an inner end of the long hole 91*a* is located adjacent to the central axis "y" of the drive shaft. The opposite ends of a section of the long hole 91*a* taken perpendicularly to the center line "S" thereof extends linearly so as to be parallel with a plane perpendicular to the axis of rotation of the drive shaft 90. A connecting pin 92 is slidably inserted into the long hole 91*a* of the rotor 91, and has an outer end thereof connected with the rotary swash plate 93 via a bracket 93*a* of the rotary swash plate 93, so that the rotary swash plate 93 can be inclined back and forth. A non-rotating wobble plate (not shown) is slidably mounted on the rotary swash plate 93, and a piston rod is provided between the wobble plate and each piston accommodated in each of a plurality of cylinder bores formed in a cylinder block of the compressor.

In the described conventional compressor, the rotation of the drive shaft 90 is converted into the rotation of the rotary swash plate 93 and the wobbling motion of the wobble plate by the action of the hinge unit "K". The wobbling motion of the wobble plate is converted into the reciprocating motion of each piston. In this case, pressure in the crank case chamber is controlled by a control valve (not shown in the drawing). Therefore, the inclination angle of the wobble plate is changed, so that the stroke of each piston is also changed. Accordingly, the discharge capacity of the compressor is changed. At this time, the back and forth tilting motion of the rotary swash plate 93 and the nutating motion of the wobble plate are restricted by the long hole 91*a* having a predetermined radius of curvature. Accordingly, although the inclination angle of the rotary swash plate 93 is changed, the top dead center of the wobble plate is unchanged in the back and forth direction, resulting in the top clearance of each piston in the corresponding cylinder bore becoming approximately zero at the top dead center of the piston.

However, in the above described type of compressor, since a suction force acts on the piston during the suction stroke thereof, the suction force also acts on the rotary swash plate 93 in a region from the top dead center to the trailing side thereof with respect to the direction of rotation of the drive shaft 90 (i.e., approximately the right half portion of the swash plate 93 in FIG. 4). On the other hand, since a compression-reaction force acts on the piston during the compression stroke thereof, the compression-reaction force also acts on the rotary swash plate 93 in a region thereof extending from the top dead center to the preceding side with respect to a direction of rotation of the drive shaft 90, i.e., approximately the left half portion of the swash plate 93 of FIG. 4. To this end, in the above-described compressor, the trailing side of the swash plate 93 with respect to the direction of rotation of the drive shaft 90 is separated away from the rotor 91, and the preceding side of the swash plate 93 with respect to the direction of rotation of the drive shaft 90 is pressed against the rotor 91.

In the compressors disclosed in the Unexamined Utility Model Publication (Kokai) No. 1-114988, the rotary swash plate 93 is mounted on the drive shaft 90 via a cylindrical sleeve (not shown in FIGS. 4 and 5), and the cylindrical sleeve supports the rotary swash plate 93 via trunnion pins so as to slide in a direction parallel with the central axis "y" of the drive shaft 90 and to nutate back and forth. Accordingly, the rotary swash plate 93 is prevented from conducting uncontrolled twisting motion in a direction different from the nutating direction with respect to the rotor 91 even when the suction force and compression-reaction force act on the rotary swash plate 93.

Nevertheless, in order to permit the rotary swash plate 93 to smoothly perform the nutating motion back and forth, a small gap must be provided between the cylindrical sleeve and the drive shaft 90. Thus, the rotary swash plate 93 is slightly twisted by the above-described suction and compression-reaction forces in a direction different from the back and forth direction with respect to the rotor 91 (for example, the rotary swash plate 93 is twisted by an angle "$\alpha$", and the connecting pin 92 comes into contact with the long hole 91*a* in a point contact condition at a point "I" in FIGS. 4 and 5. Therefore, the suction and compression-reaction forces are concentrically received at the point "I".

Further, when an input torque is exerted by the drive shaft 90, the torque is transmitted from the rotor 90 to the rotary swash plate 93 via the hinge unit "K". Therefore, when the rotary swash plate 93 is constantly twisted by a small angle in the direction different from the exact back and forth direction with respect to the rotor 91, the torque must be concentrically sustained at the point I.

Accordingly, in the conventional compressor, the hinge unit "K" provided for regulating the back and forth tilting motion of the swash plate 93 is subjected to an abnormal abrasion during the high speed operation thereof and during the high compression ratio operation thereof.

Similar problems are encountered in a case where, from the viewpoint of easy manufacture of the internal mechanism of the compressor, a sleeve element having a spherical supporting surface is slidably mounted on a drive shaft so as to support a back and forth nutating motion and a rotating motion of the rotary swash plate, respectively, and a pair of equal hinge units are disposed at positions on both sides of the top dead center of the rotary swash plate.

In addition, by suitably adjusting an arrangement of the hinge unit, the amount of a clearance "TC" defined at the top dead center of each piston changes along a curve having an upwardly convexed curvature during the change in an angle of inclination of the swash plate from the minimum inclination angle position to the maximum inclination angle position. Thus, for example, as shown by a curve "A" in FIG. 6, when the clearance TC at the top dead center of each piston is set at an optimum amount at the time when the swash plate takes the minimum inclination angle position, the amount of clearance "TC" unfavorably increases at the time when the swash plate takes the maximum inclination angle position. Otherwise, as shown by a curve "B" in FIG. 6, when the clearance TC at the top dead center of each piston is set at an optimum amount at the time when the swash plate takes the maximum inclination angle position, the amount of clearance "TC" unfavorably increases at the time when the swash plate takes the minimum inclination angle position. Namely, since the amount of clearance "TC" at the top dead center of the pistons changes by a large amount, a sufficient volumetric efficiency of the compressor cannot be obtained.

SUMMARY OF THE INVENTION

An object of the present invention is therefore to provide a hinge unit accommodated in a variable capacity swash plate type compressor for inclinably supporting a swash plate, which includes a combination of a guide hole and a spherical guided element, arranged between a rotor rotatably mounted on a drive shaft and a swash plate and has an improved durability against an abnormal wear thereof even if the swash plate is twisted around an axis extending perpendicularly with respect to an axis of rotation of the drive shaft during the operation of the compressor.

Another object of the present invention is to provide a hinge unit accommodated in a variable capacity swash plate type compressor which is improved so as to reduce a change in the top clearance of respective pistons to the smallest possible extent regardless of a change in the capacity of the compressor to thereby obtain an optimum volumetric efficiency of the compressor.

In accordance with one aspect of the present invention, there is provided a variable capacity swash plate type compressor which comprises:

a housing unit defining therein a crank chamber, a suction chamber, a discharge chamber, and a plurality of cylinder bores fluidly communicated with the suction, discharge and crank chambers;

a piston provided in each cylinder bore to be capable of reciprocatively sliding in the cylinder bore, the piston having a compressing end thereof adapted for cooperating with each of the cylinder bore to compress a refrigerant;

a drive shaft supported by the housing unit to be rotated about an axis of rotation thereof;

a rotor provided in the crank chamber and mounted on the drive shaft for rotation therewith;

a swash plate pivotally supported by the rotor via a hinge unit so as to be permitted to change an angle of inclination thereof; and a connecting unit provided between the swash plate and each of the plurality of pistons, the connecting unit being provided to convert a wobbling motion of the swash plate into a reciprocating motion of the piston, wherein the inclination angle of the swash plate is controlled by the pressure in the crank chamber so that the discharge capacity is changed, the hinge unit including a support arm protruding rearward from the rotor, and a guide pin, one end of which is fixed onto the swash plate, the support arm having a guide surface which is parallel with a surface determined by an axis of rotation of the drive shaft and also determined by the top dead center of the swash plate, the guide surface extending in a predetermined direction in which the guide surface approaches the axis of rotation of the drive shaft from the outside thereof, the guide surface being formed so that at least a front part of a section of the guide surface taken perpendicularly to a center line of said guide surface is formed in a circular arc, and the other end of said guide pin being provided with a spherical element engaged with said guide surface, the predetermined extending direction of the guide surface being determined by taking into account a position about which the swash plate is turned to change an angle of inclination thereof, a center of the spherical element of the guide pin, and the maximum and minimum angles of inclination of the swash plate whereby an amount of the top clearance TC of each piston defined as a gap between the compressing end of each piston and an end of the associated cylinder bore being unchanged at the maximum and minimum compression capacities of the compressor.

Since the front part of the section of the guide surface has a circular arc surface complimentary to the spherical element of the guide pin attached to the swash plate, the spherical element of the guide pin can constantly and stably maintain a line contact with the guide surface even when the swash plate is twisted around the axis perpendicular to the axis of rotation of the drive shaft with respect to the rotor during the operation of the compressor. Therefore, the suction force and the compression-reaction force acting on the swash plate as well as any torque component applied to the swash plate can be surely supported by the line contact portion of the spherical element of the guide pin attached to the swash plate and the guide surface of the support arm of the rotor. Further, in the described construction of the hinge unit, the guide surface of the support arm of the rotor including a portion having a circular arc section extends in parallel with a plane intersecting a different plane with which the axis of rotation of the rotor is vertical. Thus, a torque exerted by the drive shaft is surely transmitted to the spherical element of the guide pin and in turn to the swash plate, via the rotor.

Further, the hinge unit according to the first aspect of the present invention enables the respective pistons to have an approximately equivalent amount of top clearance thereof at both the maximum and minimum compression capacities of the compressor, and a change in the top clearance of the pistons can be suppressed to a small amount over the entire range of the compression capacity of the compressor. Accordingly, the volumetric efficiency of the compressor can be constant and optimum in spite of a change in the compression capacity of the compressor from the maximum to the minimum capacity.

In the above-described variable capacity swash plate chamber, the housing unit includes a cylinder block defining therein the plurality of cylinder bores arranged to axially extend, in parallel with and angularly spaced from one another, around the axis of the drive shaft, the cylinder block having an axial front end located adjacent to the crank chamber and an axial rear end located adjacent to the suction and discharge chambers, wherein when an angle extending between the center line of said guide surface extending along said predetermined direction thereof and a line intersecting the center line of said guide surface and extending perpendicularly to the axis of rotation of the drive shaft is referred to as "α", the angle "α" is set so as to satisfy an equation as set forth below:

$$\alpha=\tan^{-1}\{(n_1-n_0)/(m_1-m_0)\}$$

when $n_0$, $n_1$, $m_0$, $m_1$ are defined by the following equations $$n_0=H+(e-b)\tan\theta_0+a/\cos\theta_0+(d-a)\cos\theta_0-(c-b)\sin\theta_0$$

$$n_1=H+(e-b)\tan\theta_1+a/\cos\theta_1+(d-a)\cos\theta_1-(c-b)\sin\theta_1$$

$$m_0=b+(d-a)\sin\theta_0+(c-b)\cos\theta_0$$

$$m_1=b+(d-a)\sin\theta_1+(c-b)\cos\theta_1$$

where when an intersection of the rear end of the cylinder block and the axis of rotation of the drive shaft is defined as an origin "0", an axis coinciding with the axis of rotation of the drive shaft and having a positive region extending from the origin 0 toward a front end of the drive shaft is defined as a y-axis, an axis being perpendicular to the y-axis and extending from the origin 0 toward the top dead center of the swash plate is defined as a x-axis, an intersection between a plane defined by the x-axis and the y-axis and an axis around which the swash plate is turned so as to change an angle of inclination thereof is defined as a point $P_0$, the center of the spherical element of the guide pin is defined as a point $P_1$, an intersection between the plane defined by the x-axis and the y-axis and an axis about which the connecting unit rotates with respect to each of the pistons is defined as a point $P_2$, a length between the compressing end of each piston and the point $P_2$ is defined as "H", a line along which the plane defined by the x-axis and the y-axis and a center plane of the swash plate intersect with one another is defined as an intersecting line "$L_0$", and the center line of the guide surface of the support arm is defined as a line "$L_1$".

"a" is defined as a vertical distance between the line $L_0$ and the point $P_0$, "b" is defined as a distance between the y-axis and the point $P_0$, "c" is defined as a distance between the points on the perpendiculars, dropping from the points $P_0$ and $P_1$, on the above-mentioned line "$L_0$" less than distance "b", "d" is defined as a vertical distance between the line "$L_0$" and the point $P_1$, "e" is defined as a distance between the y-axis and the point $P_2$, "$\theta_0$" is defined as an angle of inclination of the swash plate at the maximum compression capacity, and "$\theta_1$" is defined as an angle of inclination of the swash plate at the minimum compression capacity.

Namely, in the described hinge unit for a variable capacity swash plate type compressor, since the above-described guide surface of the support arm has a specific shape cooperating with the spherical element of the guide pin, the top clearance of the respective pistons can surely be equivalent at the maximum and minimum compression capacities of the compressor.

In accordance with another aspect of the present invention, there is provided a variable capacity swash plate type compressor, which comprises:

a housing unit defining therein a crank chamber, a suction chamber, a discharge chamber, and a plurality of cylinder bores fluidly communicated with the suction, discharge and crank chambers;

a piston provided in each cylinder bore to be capable of reciprocatingly sliding in the cylinder bore, the piston having a compressing end thereof adapted for cooperating with each of the cylinder bores to compress a refrigerant;

a drive shaft supported by the housing unit to be rotated about an axis of rotation thereof;

a rotor provided in the crank chamber and mounted on the drive shaft for rotation therewith;

a swash plate pivotally supported by the rotor via a hinge unit so as to be permitted to change an angle of inclination thereof; and a connecting unit provided between the swash plate and each of the plurality of pistons, the connecting unit being provided to convert a wobbling motion of the swash plate into a reciprocating motion of the piston, wherein the inclination angle of the swash plate is controlled by the pressure in the crank chamber so that the discharge capacity is changed, the hinge unit including a support arm protruding backward from the rotor, and a guide pin, one end of which is fixed onto the swash plate, the support arm having a guide surface which is parallel with a surface determined by an axis of rotation of the drive shaft and also determined by the top dead center of the swash plate, the guide surface extending in a predetermined direction in which the guide surface approaches the axis of rotation of the drive shaft from the outside thereof, the guide surface being formed so that at least a front part of a section of the guide surface taken perpendicularly to a center line of said guide surface is formed in a circular arc, and the other end of said guide pin being provided with a spherical element engaged with said guide surface, the predetermined extending direction of the guide surface being determined by taking into account a position about which the swash plate is turned to change an angle of inclination thereof, a center of the spherical element of the guide pin, and the maximum angle of inclination of the swash plate whereby an amount of the top clearance TC of each piston defined as a gap between the compressing end of each piston and an end of the associated cylinder bore becomes the minimum possible value at the maximum compression capacity of the compressor.

Thus, a variable capacity swash plate type compressor can be assembled so that a mechanical collision of the compressing ends of the pistons with the other element or elements of the compressor is surely avoided by correctly setting only the top clearance of the pistons at the maximum compression capacity of the compressor. Accordingly, the assembly of the compressor can be simplified. Further, since the top clearance of the respective pistons at the maximum compression capacity is set at the minimum clearance condition, the volumetric efficiency of the compressor can be the maximum at the maximum compression capacity where the compressor is required to exhibit the largest refrigerating performance.

In the above-described compressor of the second aspect of the present invention, the housing unit includes a cylinder block defining therein the plurality of cylinder bores arranged to axially extend in parallel with and to be angularly spaced from one another around the axis of the drive shaft, the cylinder block having an axial front end located adjacent to the crank chamber and an axial rear end located adjacent to the suction and discharge chambers, wherein when an angle measured between the center line of said guide surface extending along said predetermined direction thereof and a line intersecting the center line of said guide surface and extending perpendicularly to the axis of rotation of the drive shaft is referred to as "α", the angle "α" is set so as to satisfy an equation as set forth below:

$$\alpha \leqq \tan^{-1}\{(n-n_0)/(m-m_0)\}$$

when n, $n_0$, m, $m_0$ are defined by the following equations $$n=H+(e-b)\tan\theta+a/\cos\theta+(d-a)\cos\theta-(c-b)\sin\theta$$

$$n_0=H+(e-b)\tan\theta_0+a/\cos\theta_0+(d-a)\cos\theta_0-(c-b)\sin\theta_0$$

$$m=b+(d-a)\sin\theta+(c-b)\cos\theta$$

$$m_0=b+(d-a)\sin\theta_0+(c-b)\cos\theta_0$$

where when an intersection of the rear end of the cylinder block and the axis of rotation of the drive shaft is defined as an origin "0", an axis coinciding with the axis of rotation of the drive shaft and having a positive region extending from the origin 0 toward a front end of the drive shaft is defined as a y-axis, an axis being perpendicular to the y-axis and extending from the origin 0 toward the top dead center of the swash plate is defined as a x-axis, an intersection between a plane defined by the x-axis and the y-axis and an axis around which the swash plate is turned so as to change an angle of inclination thereof is defined as a point $P_0$, the center of the spherical element of the guide pin is defined as a point $P_1$, an intersection between the plane defined by the x-axis and the y-axis and an axis about which the connecting unit rotates with respect to each of the pistons is defined as a point $P_2$, a length between the compressing end of each piston and the point $P_2$ is defined as "H", a line along which the plane defined by the x-axis and the y-axis and a center plane of the swash plate intersect with one another is defined as an intersecting line "$L_0$", and the center line of the guide surface of the support arm is defined as a line "$L_1$", "a" is defined as a vertical distance between the line $L_0$ and the point $P_0$, "b" is defined as a distance between the y-axis and the point $P_0$, "c" is defined as a distance between the points on perpendiculars dropping from the points $P_0$ and $P_1$ at the above-mentioned line "$L_0$" less the distance "b", "d" is defined as a vertical distance between the line "$L_0$" and the point $P_1$, "e" is defined as a distance between the y-axis and the point $P_2$, "θ" is defined as an angle of inclination of the swash plate at a given compression capacity, and "$\theta_0$" is defined as an angle of inclination of the swash plate at the maximum compression capacity.

Thus, the top clearance of the respective pistons of the compressor at the maximum compression capacity can be the minimum clearance condition.

BRIEF DESCRIPTION OF THE DRAWINGS

The above and other objects, features, and advantages of the present invention will become apparent from the ensuing description of preferred embodiments thereof, in conjunction with the accompanying drawings wherein.

DESCRIPTION OF THE PREFERRED EMBODIMENTS

Figure 1:
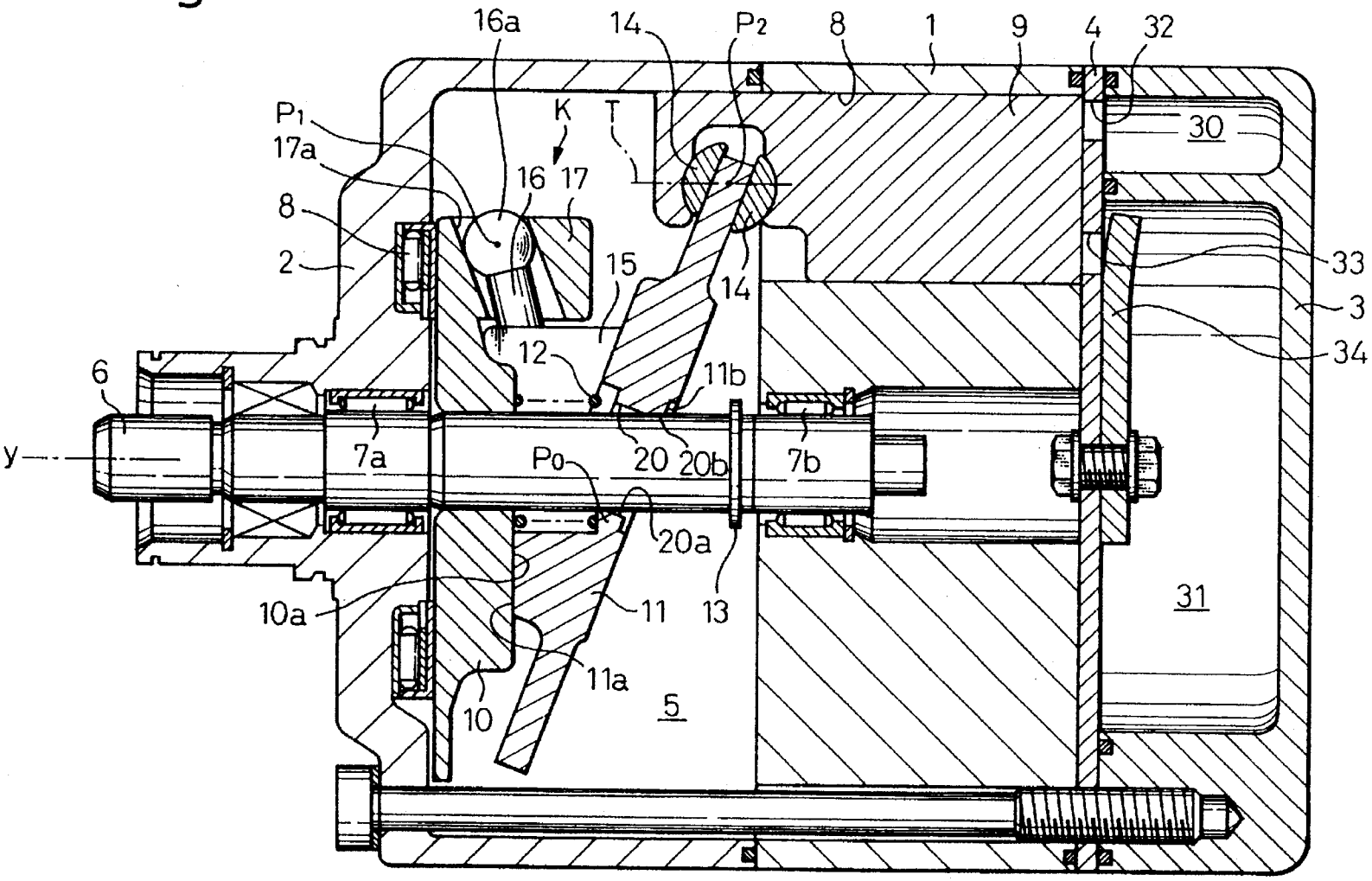
FIG. 1 is a longitudinal cross-sectional view of a variable capacity swash plate type compressor accommodating therein a hinge unit according to first and second embodiments thereof.
Figure 2:
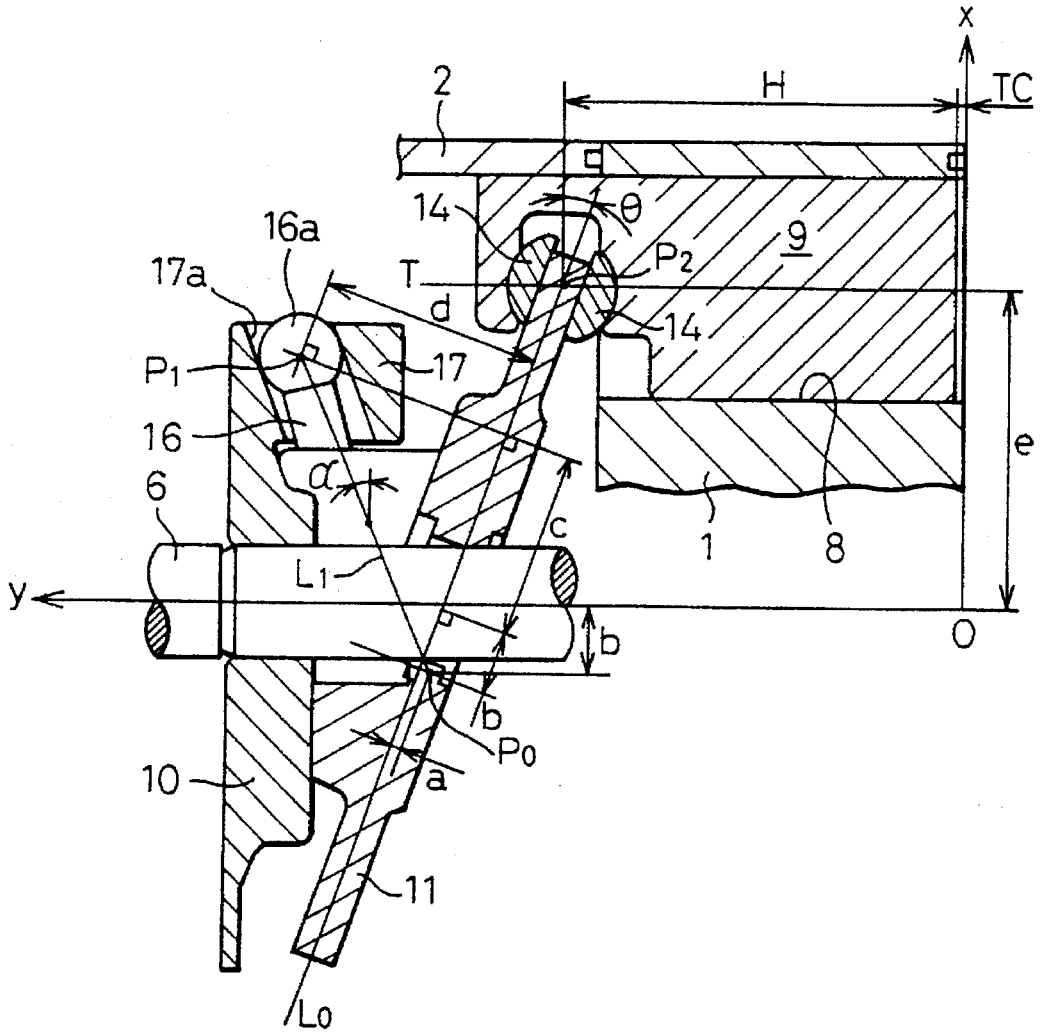
FIG. 2 is a cross-sectional view of an important portion of the hinge unit of the compressor of FIG. 1, illustrating the detailed construction of the hinge unit.

Referring to FIGS. 1 and 2, the compressor has a front housing 2 which is joined to one side of a cylinder block 1 forming a part of an entire housing unit, and a rear housing 3 joined to the other side of the cylinder block 1 through a valve plate 4. A drive shaft 6 having an axis "y" of rotation thereof is provided in a crank chamber 5 formed by the cylinder block 1 and front housing 2. The drive shaft 6 is rotatably supported by anti-friction bearings 7*a*, 7*b*. A plurality of cylinder bores 8 are formed in the cylinder block 1 at plurality of positions surrounding the drive shaft 6. A piston 9 is respectively inserted into each cylinder bore 8 of the cylinder block 1.

In the crank chamber 5, a rotor 10 is mounted on the drive shaft 6 so as to be rotated together with the drive shaft 6 under the support of a thrust bearing 8 seated against an inner end of the front housing 2. A swash plate 11 having an axial through-hole 20 formed thereon is mounted on the drive shaft 6 via the axial through-hole 20 which is bored by using a drill and an end milling cutter. Namely, the through-hole 20 of the swash plate 11 is formed with a cylindrical hole portion 20*a* bored by the drill and a curved hole portion 20*b* cut by the end milling tool so as to have a cylindrically curved surface extending with respect to an axis about which the swash plate 11 is turned so as to change an angle of inclination thereof. The curved hole portion 20*b* is contiguous with the cylindrical hole portion 20*a*.

The through-hole 20 of the swash plate 11 is provided with a pair of flat inner walls (not shown) extending in parallel with the axis "y" of rotation of the drive shaft 6 so as to adjustably control the turning motion of the swash plate 11 about the above-mentioned axis.

A pushing spring 12 mounted around the drive shaft 6 is interposed between the rotor 10 and the swash plate 11. The pushing spring 12 pushes the swash plate 11 in a direction toward the rear housing 3.

Hemispherical shoes 14, 14 come into contact with the outer circumferential portion of the rotary swash plate 11, and the outer circumferential surfaces of these shoes 14, 14 are engaged with spherical supporting surfaces of the piston 9. In this way, the plurality of pistons 9 are engaged, at front ends thereof, with the rotary swash plate 11 via the shoes 14, 14. The respective pistons 9 are slidably accommodated in respective cylinder bores 8 so as to be reciprocated in the cylinder bores 8, and are provided with rear ends formed as compressing ends.

Figure 3:
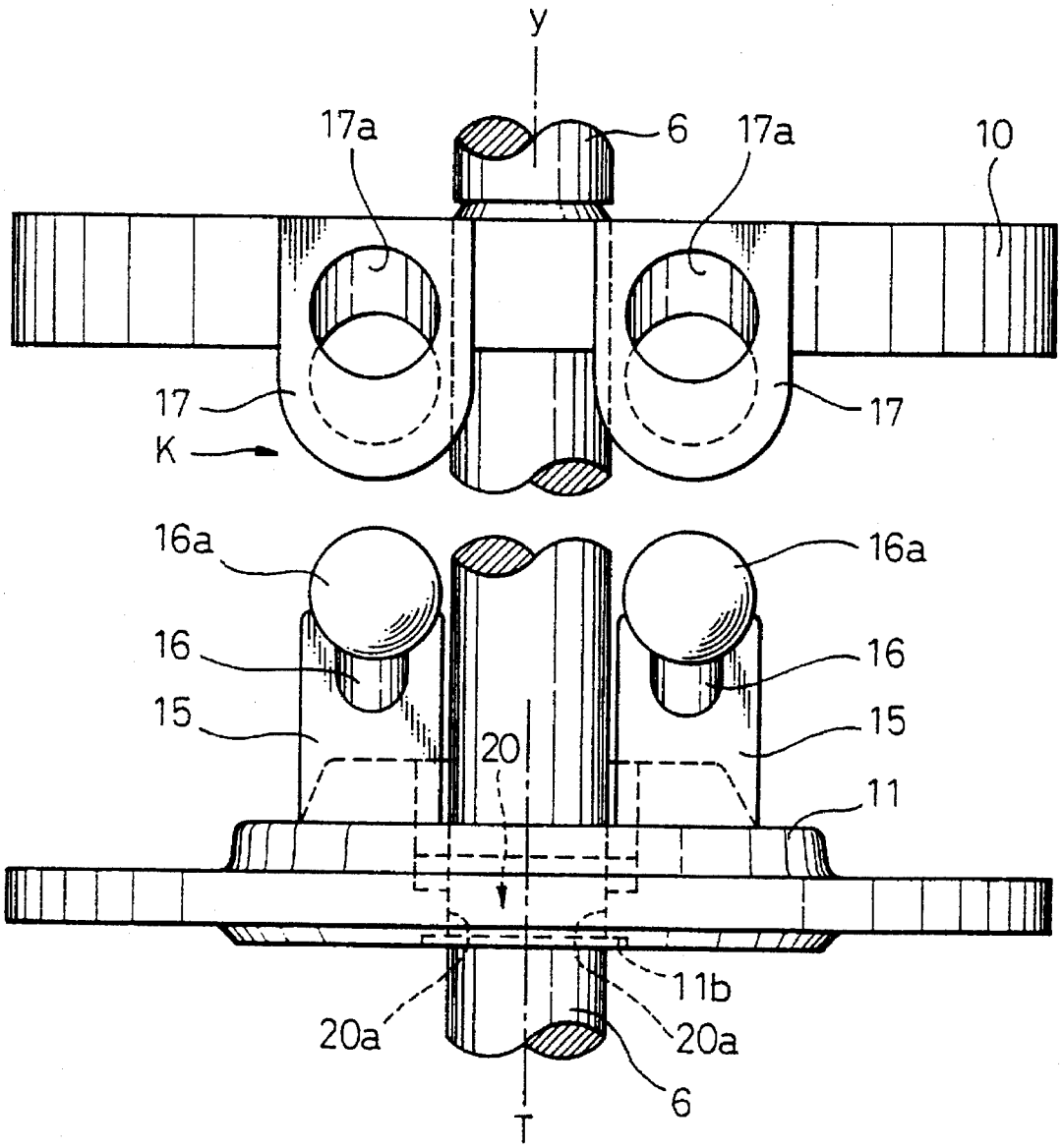
FIG. 3 is an exploded plan view of the hinge unit accommodated in a variable capacity swash plate type compressor of FIG. 1.
Figure 4:
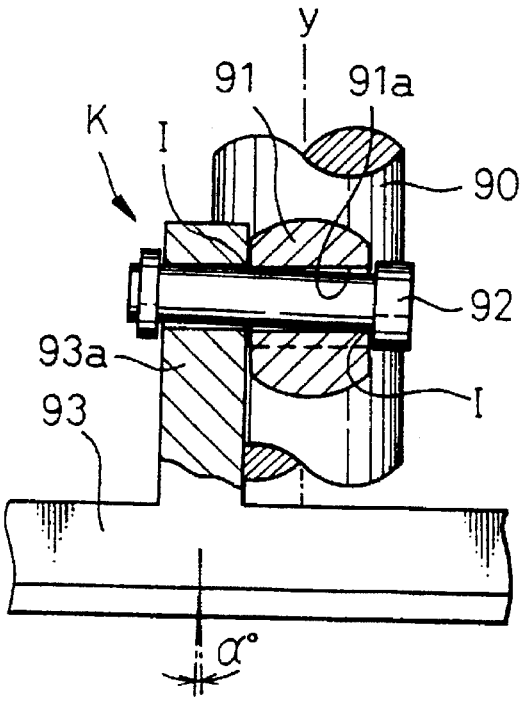
Fig.4 PRIOR ART
FIG. 4 is a partial view of a hinge unit according to the prior art.
Figure 5:
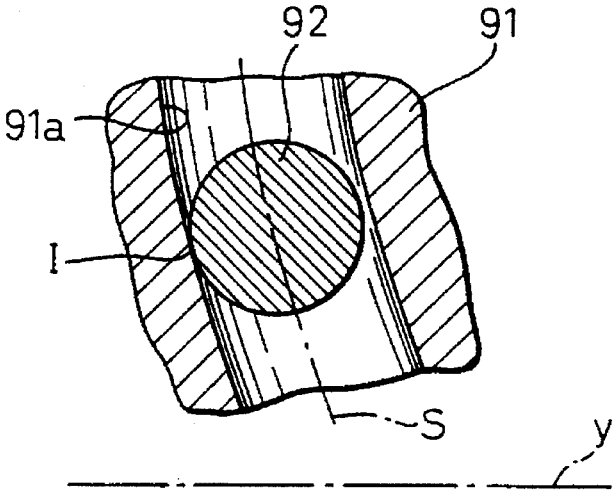
Fig.5 PRIOR ART
FIG. 5 is an enlarged view of the hinge unit of the prior art, illustrating the relationship between the guide surface and the spherical element of the guide pin.

As illustrated in FIG. 3, a pair of brackets 15, 15 composing a part of the hinge unit "K" are protruded from the back surface of the rotary swash plate 11, and disposed on both sides of the top dead center "T" of the rotary swash plate 11, and the drive shaft 6 is arranged so as to be interposed between the two brackets 15, 15 of the rotary swash plate 11. A pair of guide pins 16 are fixed to the brackets 15 at one end thereof, and the other ends of the two guide pins 16 are each fixed respectively to a spherical element 16*a*.

A pair of support arms 17, 17 composing the remaining part of the hinge unit "K" are protruded from an upper front surface of the rotor 10 in the rear direction of the drive shaft 6 in such a manner that the support arms 17, 17 are opposed to the guide pins 16, 16. A circular guide hole 17*a* is linearly formed at the fore end of each support arm 17 in parallel with a plane determined by the axis "y" of rotation of the drive shaft 6 and the top dead center "T" of the rotary swash plate 11 in a direction in which the guide hole 17*a* radially approaches the rotating axis "y" of the drive shaft 6 from outside the drive shaft 6. An inner circumferential surface of the guide hole 17*a* works as a guide surface, and the spherical element 16*a* of each guide pin 16 is rotatably and slidably fitted in the guide hole or guide surface 17*a* of each support arm 17.

As illustrated in FIG. 1, the inside of the rear housing 3 is divided into suction and discharge chambers 30 and 31. Suction ports 32 and discharge ports 33 are formed in a valve plate 4 so as to positionally correspond to respective cylinder bores 8. A compression chamber formed between the valve plate 4 and the compressing ends of the respective pistons 9 is communicated with the suction chamber 30 and the discharge chamber 31 via the suction and discharge ports 32 and 33. Each suction port 32 is covered by a suction valve which opens and closes the suction port 32 in accordance with the reciprocating motion of the piston 9. Each discharge port 33 is covered by a discharge valve which opens and closes the discharge port 33 in accordance with the reciprocating motion of the piston 9 while the opening motion of the discharge valve is restricted by a retainer 34.

The rear housing 3 receives therein a control valve (not shown) which adjustably changes the pressure level in the afore-mentioned crank chamber 5.

In the described compressor, as shown in FIG. 2, a center line $L_1$ of each of the pair of guide holes 17*a*, 17*a* (only one guide hole 17*a* is typically illustrated in FIG. 2), i.e., a line indicating a predetermined direction in which the guide hole 17*a* extends forms a characteristic angle "α" with respect to a line vertical to the axis "y" of rotation of the drive shaft 6.

At this stage, when an intersection of the rear end of the cylinder block 1 and the axis "y" of rotation of the drive shaft 6 is defined as an origin "0", an axis coinciding with the axis "y" of rotation of the drive shaft 6 and having a positive region extending from the origin "0" toward a front end of the drive shaft 6 is defined as a y-axis, an axis being perpendicular to the y-axis and having a positive region thereof which extends from the origin "0" toward the top dead center of the swash plate is defined as a x-axis. Although a z-axis may be defined as an axis which extends from the origin "0" in a direction perpendicular to a plane defined by the x-axis and y-axis, all positions on both faces of the swash plate 11 are unchanged in the direction of the z-axis during the turning motion of the swash plate 11 to change an angle of inclination thereof. Thus, no consideration is needed in the analysis of the turning motion of the swash plate 11, with respect to the z-axis.

Analysis of the angle "α" of the line $L_1$ of the guide hole 17*a* of the hinge unit K is described below in relation to the x-axis and y-axis.

First, the following definitions are provided before beginning the description of the analysis.

$P_0$: an intersection between a plane defined by the x-axis and the y-axis and an axis around which the swash plate is turned so as to change an angle of inclination thereof $P_1$: the center of both spherical elements 16*a*, 16*a* of the guide pin 16

$P_2$: an intersection between the plane defined by the x-axis and the y-axis and an axis about which the shoes 14, 14 rotate with respect to each of the pistons 9

H: a distance or length between the compressing end of each piston 9 and the point $P_2$ $L_0$: a line along which the plane defined by the x-axis and the y-axis and a center plane of the swash plate 11 intersect with one another $L_1$: the center line of the guide hole or surface 17*a* of the support arm 17 a: a vertical distance between the line $L_0$ and the point $P_0$ (it is regarded as positive when taken in the frontward direction, and as negative when taken in the rearward)

b: a distance between the y-axis and the point $P_0$ (it is regarded as positive when taken in the direction toward the top dead center, and as negative when taken in the direction toward the bottom dead center)

c: a distance between points on the perpendiculars dropped from the points $P_0$ and $P_1$ to the above-mentioned line "$L_0$" less than the distance "b"

d: a vertical distance between the line "$L_0$" and the point $P_1$ e: a distance between the y-axis and the point $P_2$ θ: an angle of inclination of the swash plate 11 at a given compression capacity, $\theta_0$: an angle of inclination of the swash plate 11 at the maximum compression capacity $\theta_1$: an angle of inclination of the swash plate 11 at the minimum compression capacity TC: the top clearance of the piston 9 at the top dead center thereof $TC_0$: the top clearance of the piston 9 at the maximum compression capacity $TC_1$: the top clearance of the piston 9 at the minimum compression capacity Then, the coordinates of the point $p_0$ ($P_{0x}$, $P_{0y}$) can be defined by equations (1) and (2) as set forth below.

$$P_{0x}=b \tag{1}$$

$$P_{0y}=TC+H+(e-b)\tan\theta+a/\cos\theta \tag{2}$$

Further, the coordinates of the point $p_1$ ($P_{1x}$, $P_{1y}$) can be defined by equations (3) and (4) as set forth below.

$$P_{1x}=P_{0x}+(d-a)\sin\theta+(c-b)\cos\theta \tag{3}$$

$$P_{1y}=P_{0y}+(d-a)\cos\theta-(c-b)\sin\theta \tag{4}$$

The center line $L_1$ of the guide hole 17*a* of the support arm 17 in the x, y-axis coordinate system can be defined by an equation (5) below.

$$y=ux+v \tag{5}$$

where u is an inclination of the center line $L_1$, and v is a value at which the center line $L_1$ crosses the y-axis. Then, the inclination "u" of the center line $L_1$ can be expressed by an equation (6) as set forth below.

$$u=\tan\alpha \tag{6}$$

Further, a consideration is made to obtain a relationship between the angle of inclination θ of the swash plate 11 and the top clearance TC of the piston 9. At this stage, since the point $P_1$ is constantly located on the center line $L_1$, and moves on the line $L_1$ in response to a change in the angle θ of inclination of the swash plate 11, an equation (7) shown below can be derived from the equation (5).

$$P_{1y}=uP_{1x}+v \tag{7}$$

When the equations (1) through (4) are applied to the equation (7), the following equation is obtained.

$$TC+H+(e-b)\tan\theta+a/\cos\theta+(d-a)\cos\theta-(c-b)\sin\theta=u\{b+(d-a)\sin\theta+(c-b)\cos\theta+v$$

Thus, an equation (8) as set forth below can be obtained from the above equation.

$$TC=u\{b+(d-a)\sin\theta+(c-b)\cos\theta\}+v-\{H+(e-b)\tan\theta+a/\cos$$

$$\theta+(d-a)\cos\theta-(c-b)\sin\theta\} \quad (8)$$

At this stage, a consideration is taken to obtain a specific value of the angle "α" of inclination of the center line $L_1$ to make the change in the top clearance TC to the minimum. Namely, in order to reduce an extent of a change in the top clearance TC due to a change in the angle θ of inclination of the swash plate 11, the value of "u" is determined so as to obtain $TC_0=TC_1$. From the equation (8), $$TC_0=um_0+v-n_0 \quad (9)$$

$$TC_1=um_1+v-n_1 \quad (10)$$

However, the following relationships must be satisfied.

$$m_0=b+(d-a)\sin\theta_0+(c-b)\cos\theta_0$$

$$n_0=H+(e-b)\tan\theta_0+a/\cos\theta_0+(d-a)\cos\theta_0-(c-b)\sin\theta_0$$

$$m_1=b+(d-a)\sin\theta_1+(c-b)\cos\theta_1$$

$$n_1=H+(e-b)\tan\theta_1+a/\cos\theta_1+(d-a)\cos\theta_1-(c-b)\sin\theta_1$$

When the relationship $TC_0=TC_1$ is applied to the equations (9) and (10), the value "u" is determined as shown below.

$$u=(n_1-n_0)/(m_1-m_0) \quad (11)$$

Accordingly, by applying the equation (11) to the equation (6), the value "α" can be determined by an equation (12) as set forth below.

$$\alpha=\tan^{-1}\{(n_1-n_0)/(m_1-m_0)\} \quad (12)$$

Thus, in the compressor according to the first embodiment, the angle "α" of the center line $L_1$ is determined from the position $P_0$ of the axis around which the swash plate 11 is turned so as to change an angle of inclination thereof, the center $P_1$ of the spherical element 16*a* of the guide pin 16, the point $P_2$ at which a compression-reaction force acts on the swash plate 11 from one of the pistons 9 which is moved to the top dead center, the maximum angle $\theta_0$ of inclination of the swash plate 11, and the minimum angle $\theta_1$ of inclination of the swash plate 11. Thus, in construction the hinge unit K, the guide holes 17*a*, 17*a* of both support arms 17, 17 are bored so that the center line $L_1$ thereof is inclined to have the above determined angle "α".

When the variable capacity swash plate type compressor provided with the hinge unit "K" having the above-described construction is operated by rotating the drive shaft 6 by an external drive force such as a drive force given by an external automobile engine, the swash plate 11 is rotated. Thus, the respective pistons 9 are reciprocated by the rotating swash plate 11 and the shoes 14,14, within the corresponding cylinder bores 8. Thus, the refrigerant gas is sucked from the suction chamber 30 into the respective compression chambers within the cylinder bores 8, and is compressed therein. The compressed refrigerant gas is in turn discharged from the compression chambers into the discharge chamber 31. The capacity of the compressed refrigerant gas discharged into the discharge chamber 31 is adjustably changed by the control valve which acts so as to adjustably change the pressure prevailing in the crank chamber 5.

During the operation of the compressor, the spherical elements 16*a*, 16*a* of the guide pins 16, 16 are constantly guided by the guide holes 17*a*, 17*a* having at least a part thereof formed to have a circular section taken perpendicularly to the center line $L_1$. Thus, even if the swash plate 11 is twisted from its ordinary position thereof with respect to the rotor 10, the spherical elements 16*a*, 16*a* of the guide pins 16, 16 of the hinge unit "K" are maintained to be in line contact with the guide holes 17*a*, 17*a* of the support arms 17, 17 of the rotor 10. Accordingly, the suction force, the compression-reaction force, and the torque acting on the swash plate 11 can be rigidly supported by the line contact portions of the hinge unit "K".

Further, in the described compressor, since the circular guide holes (guide surfaces) 17*a*, 17*a* of the pair of support arms 17, 17 extend in such a manner that the circular section of each circular guide hole 17*a* crosses a plane along which the rotation of the rotor 16 occurs, the torque transmitted from the drive shaft 6 to the rotor 10 can be easily transmitted to the spherical elements 16*a*, 16*a* of the guide pins 16, 16 of the hinge unit "K". Accordingly, during the operation of the compressor, the hinge unit "K" for turnably supporting the rotary swash plate 11 can be surely prevented from being abnormally worn away. Therefore, the durability of the hinge unit "K" and in turn, the compressor can be enhanced.

Figure 6:
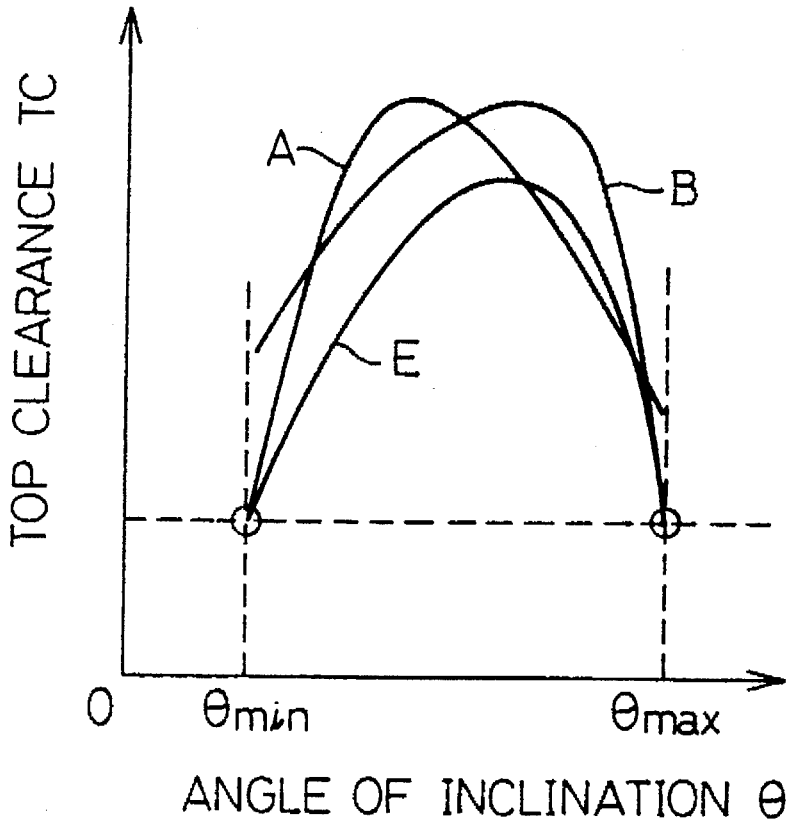
FIG. 6 is a graph indicating characteristic curves between the angle of inclination of a swash plate of a variable capacity swash plate type compressor and the top clearance of the respective pistons according to the prior art and the present invention.

Moreover, the top clearance TC of the respective pistons 9 at both maximum and minimum compression capacities of the compressor can be set to be equivalent. Accordingly, even though a change in the top clearance TC occurs along a upwardly convexed curve as shown by the curve "E" in FIG. 6 during the change in the angle of inclination of the swash plate 11 from the minimum angle $\theta_1$ to the maximum angle $\theta_0$, the highest position of the curve "E", i.e., the extent of the change in the top clearance TC can be suppressed to be the smallest possible. Therefore, the volumetric compression efficiency of the compressor can be optimum.

In the second embodiment of the present invention, the angle α of the center line $L_1$ of the guide holes 17*a*, 17*a* of the support arm 17,17 of the rotor 10 of the compressor is set by a different manner from the described first embodiment. Moreover, the mechanical construction of the hinge unit "K" and the remaining portion of the compressor are equivalent to those of the first embodiment.

In the second embodiment, the above-mentioned angle α is set in such a manner that the top clearance TC of the respective pistons 9 becomes the minimum during the change in the compression capacity from the minimum to the maximum compression capacities of the compressor. Namely, the angle α is determined so that the relationship $TC_0 \leqq TC$ can be constantly satisfied during a change in the angle "θ" of inclination of the swash plate 11 from the minimum angle $\theta_1$ to the maximum angle $\theta_0$.

To this end, from the equation (11), an inequality (13) as set forth below is obtained.

$$u \leqq (n-n_0)/(m-m_0) \quad (13)$$

However, the following equations must be satisfied.

$$n=H+(e-b)\tan\theta+a/\cos\theta+(d-a)\cos\theta-(c-b)\sin\theta$$

$$m=b+(d-a)\sin\theta+(c-b)\cos\theta$$

Thus, from the equation (6), the angle α of inclination of the center line $L_1$ of the guide holes 17*a*, 17*a* can be determined by an equation (14) as set forth below.

$$\alpha \leqq \tan^{-1}\{(n-n_0)/(m-m_0)\} \quad (14)$$

Namely, in the second embodiment, the angle "α" of the center line $L_1$ of the guide holes 17*a*, 17*a* is determined from the position $P_0$ of the axis around which the swash plate 11 is turned so as to change an angle of inclination thereof, the center $P_1$ of the spherical element 16*a* of the guide pin 16, the point $P_2$ at which a compression-reaction force acts on the swash plate 11 from one of the pistons 9 which is moved to the top dead center, and the maximum angle $\theta_0$ of inclination of the swash plate 11. Thus, in the construction of the hinge unit K of the second embodiment, the guide holes 17*a*, 17*a* of the support arm 17 are bored so that the center line $L_1$ thereof is inclined to have the above angle "α" determined so as to satisfy the inequality (14).

In the compressor provided with the hinge unit "K" of the second embodiment, the top clearance TC of the respective pistons 9 takes the smallest value at the maximum capacity operation of the compressor. Otherwise, the performance of the compressor according to the second embodiment is similar to that of the compressor of the first embodiment.

In accordance with the second embodiment, when the compressor is assembled, if a confirmation is made by an operator or an assembler so that the top clearance TC of the respective pistons 9 only at the maximum compression capacity is appropriately set at a designed minimum value, it is possible to prevent the pistons 9 from coming into direct contact with the valve plate 4 during the operation of the compressor. Thus, the assembly of the compressor can be simplified by omitting cumbersome measuring operation of the top clearance TC of the pistons 9 at various compression capacities. Thus, the manufacturing and the assembly of the compressor can be made easy.

Further, since the top clearance TC of the pistons 9 at the maximum compression capacity where the maximum refrigeration performance is needed can be set at the minimum value, the maximum volumetric efficiency of the compressor can be achieved by the compressor of the second embodiment.

As described above in detail, the compressor provided with the hinge unit "K" of the present invention employs the construction described in the claims. Therefore, the following excellent effects can be provided.

(1) Even when the swash plate is inclined in the transverse direction (or twisted around an axis which is perpendicular to both the axis of rotation of the drive shaft and the axis of turning of the swash plate) with respect to the rotor, the spherical elements of the guide pins come into contact with the guide surfaces in a line contact condition. Therefore, the hinge unit is always prevented from being abnormally worn away. Consequently, this compressor can exhibit excellent durability.

(2) Since the top clearance of the pistons are set so as to desired conditions determined by the specified design concept of the hinge unit "K", the volumetric efficiency of the compressor can be optimum.

(3) The compressor can be easily manufactured.

What we claim:

1. A variable capacity swash plate type compressor, comprising:

a housing means defining therein a crank chamber, a suction chamber, a discharge chamber, and a plurality of cylinder bores fluidly communicated with said suction, discharge and crank chambers;

a piston provided in each cylinder bore to be capable of reciprocatingly sliding in said cylinder bore, said piston having a compressing end thereof adapted for cooperating with each of said cylinder bores to compress a refrigerant;

a drive shaft supported by said housing means to be rotated about an axis of rotation thereof;

a rotor provided in said crank chamber and mounted on said drive shaft for rotation therewith;

a swash plate pivotally supported by said rotor via a hinge means so as to be permitted to change an angle of inclination thereof; and a connecting means provided between said swash plate and each of said plurality of pistons, said connecting means being provided to convert a wobbling motion of said swash plate into a reciprocating motion of said pistons, wherein the inclination angle of said swash plate is controlled by pressure in said crank chamber so that compression capacity of said compressor is changed, said hinge means comprising a support arm protruding rearward from said rotor, and a guide pin, one end of which is fixed onto said swash plate, said support arm having a guide surface which is parallel with a surface determined by an axis of rotation of said drive shaft and also determined by the top dead center of said swash plate, said guide surface extending in a predetermined direction in which said guide surface approaches said axis of rotation of said drive shaft from said outside thereof, said guide surface being formed so that at least a front part of a section of said guide surface taken perpendicularly to a center line of said guide surface is formed in a circular arc, and said other end of said guide pin being provided with a spherical element engaged with said guide surface, the predetermined extending direction of said guide surface being determined by taking into account a position about which said swash plate is turned to change an angle of inclination thereof, a center of said spherical element of said guide pin, and the maximum and minimum angles of inclination of said swash plate whereby an amount of the top clearance TC of each piston defined as a gap between said compressing end of each piston and an end of the associated cylinder bore being unchanged at the maximum and minimum compression capacities of said compressor.

2. The compressor according to claim 1 wherein said housing means comprises a cylinder block defining therein the plurality of said cylinder bores arranged to axially extend in parallel with, and to be angularly spaced from, one another around the axis of rotation of said drive shaft, said cylinder block having an axial front end located adjacent to said crank chamber and an axial rear end located adjacent to said suction and discharge chambers, wherein when an angle extending between the center line of said guide surface extending along said predetermined direction thereof and a line intersecting the center line of said guide surface and extending perpendicularly to the axis of rotation of said drive shaft is referred to as "α", the angle "α" is set so as to satisfy an equation as set forth below:

$$\alpha = \tan^{-1}\{(n_1-n_0)/(m_0-m_0)\}$$

when $n_0$, $n_1$, $m_0$, $m_1$ are defined by the following equations $$n_0 = H + (e-b)\tan\theta_0 + a/\cos\theta_0 + (d-a)\cos\theta_0 - (c-b)\sin\theta_0$$

$$n_1 = H + (e-b)\tan\theta_1 + a/\cos\theta_1 + (d-a)\cos\theta_1 - (c-b)\sin\theta_1$$

$$m_0=b+(d-a)\sin\theta_0+(c-b)\cos\theta_0$$

$$m_1=b+(d-a)\sin\theta_1+(c-b)\cos\theta_1$$

where when an intersection of the rear end of said cylinder block and the axis of rotation of said drive shaft is defined as an origin "0", an axis coinciding with the axis of rotation of said drive shaft and having a positive region extending from the origin 0 toward a front end of said drive shaft is defined as a y-axis, an axis being perpendicular to the y-axis and extending from the origin 0 toward the top dead center of said swash plate is defined as a x-axis, an intersection between a plane defined by the x-axis and the y-axis and an axis around which said swash plate is turned so as to change an angle of inclination thereof is defined as a point $P_0$, the center of said spherical element of said guide pin is defined as a point $P_1$, an intersection between the plane defined by the x-axis and the y-axis and an axis about which said connecting means rotates with respect to each of said pistons is defined as a point $P_2$, a length between said compressing end of each piston and the point $P_2$ is defined as "H", a line along which the plane defined by the x-axis and the y-axis and a center plane of said swash plate intersect with one another is defined as an intersecting line "$L_0$", and the center line of said guide surface of said support arm is defined as a line "$L_1$", "a" is defined as a vertical distance between the line $L_0$ and the point $P_0$, "b" is defined as a distance between the y-axis and the point $P_0$, "c" is defined as a distance between the points on the perpendiculars dropping from the points $P_0$ and $P_1$ at the above-mentioned line "$L_0$" less the distance "b", "d" is defined as a vertical distance between the line "$L_0$" and the point $P_1$, "e" is defined as a distance between the y-axis and the point $P_2$, "$\theta_0$" is defined as an angle of inclination of said swash plate at the maximum compression capacity, and "$\theta_1$" is defined as an angle of inclination of said swash plate at the minimum compression capacity.

3. The compressor according to claim 1, wherein said connecting means comprises a plurality of pairs of semi-spherical shoes, each pair of shoes being arranged between an outer portion of said swash plate and each of said plurality of pistons.

4. A variable capacity swash plate type compressor, comprising:

a housing means defining therein a crank chamber, a suction chamber, a discharge chamber, and a plurality of cylinder bores fluidly communicated with said suction, discharge and crank chambers;

a plurality of pistons provided in said plurality of cylinder bores to be capable of reciprocatively sliding in said cylinder bores, each of said pistons having a compressing end thereof adapted for cooperating with each of said cylinder bores to compress a refrigerant;

a drive shaft supported by said housing means to be rotated about an axis of rotation thereof;

a rotor provided in said crank chamber and mounted on said drive shaft for rotation therewith;

a swash plate pivotally supported by said rotor via a hinge means so as to be permitted to change an angle of inclination thereof; and a connecting means provided between said swash plate and each of said plurality of pistons, said connecting means being provided to convert a wobbling motion of said swash plate into a reciprocating motion of said pistons, wherein the inclination angle of said swash plate is controlled by pressure in said crank chamber so that compression capacity of said compressor is changed, said hinge means comprising a support arm protruding backward from said rotor, and a guide pin, one end of which is fixed onto said swash plate, said support arm having a guide surface which is parallel with a surface determined by an axis of rotation of said drive shaft and also determined by the top dead center of said swash plate, said guide surface extending in a predetermined direction in which said guide surface approaches the axis of rotation of said drive shaft from the outside thereof, said guide surface being formed so that at least a front part of a section of said guide surface taken perpendicularly to a center line of said guide surface is formed in a circular arc, and the other end of said guide pin being provided with a spherical element engaged with said guide surface, the predetermined extending direction of said guide surface being determined by taking into account a position about which said swash plate is turned to change an angle of inclination thereof, a center of said spherical element of said guide pin, and the maximum angle of inclination of said swash plate whereby an amount of the top clearance TC of each piston defined as a gap between said compressing end of each piston and an end of said associated cylinder bore becomes the minimum possible value at the maximum compression capacity of said compressor.

5. The compressor according to claim 4, wherein said housing means includes a cylinder block defining therein said plurality of cylinder bores arranged to axially extend in parallel with, and to be angularly spaced from, one another around the axis of said drive shaft, said cylinder block having an axial front end located adjacent to said crank chamber and an axial rear end located adjacent to said suction and discharge chambers, wherein when an angle measured between the center line of said guide surface extending along said predetermined direction thereof and a line intersecting the center line of said guide surface and extending perpendicularly to the axis of rotation of said drive shaft is referred to as "α", the angle "α" is set so as to satisfy an equation as set forth below:

$$\alpha\leqq\tan^{-1}\{(n-n_0)/(m-m_0)\}$$

when n, $n_0$, m, $m_0$ are defined by the following equations $$n=H+(e-b)\tan\theta+a/\cos\theta+(d-a)\cos\theta-(c-b)\sin\theta$$

$$n_0=H+(e-b)\tan\theta_0+a/\cos\theta_0+(d-a)\cos\theta_0-(c-b)\sin\theta_0$$

$$m=b+(d-a)\sin\theta+(c-b)\cos\theta$$

$$m_0=b+(d-a)\sin\theta_0+(c-b)\cos\theta_0$$

where when an intersection of said rear end of said cylinder block and the axis of rotation of said drive shaft is defined as an origin "0", an axis coinciding with the axis of rotation of said drive shaft and having a positive region extending from the origin 0 toward a front end of said drive shaft is defined as a y-axis, an axis being perpendicular to the y-axis and extending from the origin 0 toward said top dead center of said swash plate is defined as a x-axis, an intersection between a plane defined by the x-axis and the y-axis and an axis around which said swash plate is turned so as to change an angle of inclination thereof is defined as a point $P_0$, the center of said spherical element of said guide pin is defined as a point $P_1$, an intersection between said plane defined by the x-axis and the y-axis and an axis about which said connecting means rotates with respect to each of said pistons is defined as a point $P_2$, a length between said compressing end of each piston and the point $P_2$ is defined as "H", a line along which the plane defined by the x-axis and the y-axis and a center plane of said swash plate intersect with one another is defined as an intersecting line "$L_0$", and the center line of said guide surface of said support arm is defined as a line "$L_1$", "a" is defined as a vertical distance between the line $L_0$ and the point $P_0$, "b" is defined as a distance between the y-axis and the point $P_0$, "c" is defined as a distance between the points on perpendiculars dropped from the points $P_0$ and $P_1$ on said line "$L_0$" less the distance "b", "d" is defined as a vertical distance between the line "$L_0$" and the point $P_1$, "e" is defined as a distance between the y-axis and the point $P_2$, "θ" is defined as an angle of inclination of said swash plate at a given compression capacity, and "$\theta_0$" is defined as an angle of inclination of said swash plate at the maximum compression capacity.

6. The compressor according to claim 4, wherein said connecting means comprises a plurality of pairs of semi-spherical shoes, each pair of shoes being arranged between an outer portion of said swash plate and each of said plurality of pistons.

* * * * *